US011731813B2

(12) United States Patent
Yang

(10) Patent No.: US 11,731,813 B2
(45) Date of Patent: Aug. 22, 2023

(54) CONTAINER BOTTLE JOINT AND CONTAINER BOTTLE ASSEMBLY

(71) Applicant: Shenzhen Weile Sanitary Ware Hardware and Electrical Appliance Building Materials Co., LTD, Shenzhen (CN)

(72) Inventor: Zhongxiong Yang, Shenzhen (CN)

(73) Assignee: Shenzhen Weile Sanitary Ware Hardware and Electrical Appliance Building Materials Co., LTD, Shenzhen (CN)

( * ) Notice: Subject to any disclaimer, the term of this patent is extended or adjusted under 35 U.S.C. 154(b) by 32 days.

(21) Appl. No.: 17/671,982

(22) Filed: Feb. 15, 2022

(65) Prior Publication Data

US 2022/0169424 A1 Jun. 2, 2022

Related U.S. Application Data

(63) Continuation of application No. PCT/CN2021/113312, filed on Aug. 18, 2021.

(30) Foreign Application Priority Data

Nov. 17, 2020 (CN) ..... 202011286065.9

(51) Int. Cl.
*B65D 47/06* (2006.01)
*B65D 47/32* (2006.01)

(52) U.S. Cl.
CPC ..... *B65D 47/06* (2013.01); *B65D 47/32* (2013.01)

(58) Field of Classification Search
CPC ..... B65D 47/06; B65D 47/32; E03B 7/07; E03C 1/04; E03C 2201/40; A47K 3/28; A47K 5/12

(Continued)

(56) References Cited

U.S. PATENT DOCUMENTS 2,953,305 A * 9/1960 Bondurant ..... B05B 7/1209 239/353
3,670,929 A * 6/1972 Berry ..... B67D 1/0831 222/400.7

(Continued)

FOREIGN PATENT DOCUMENTS

CN 204261449 U 4/2015
CN 106430372 A 2/2017

(Continued)

OTHER PUBLICATIONS

International Search Report and Written Opinion issued in corresponding PCT Application No. PCT/CN2021/113312, dated Nov. 4, 2021.

*Primary Examiner* — Lien M Ngo
(74) *Attorney, Agent, or Firm* — Westbridge IP LLC

(57) ABSTRACT

Disclosed are a container bottle joint and a container bottle assembly. The container bottle joint includes: a cover body comprising a water inlet pipeline and a water outlet pipeline extending upper and lower direction; a water inlet valve including a first spool, a first elastic member and a first sealing member, in particular the first spool is slidably arranged in the water inlet pipeline from top to bottom, and an upper end of the first spool is connected with the first sealing member; the first elastic member is arranged in the water inlet pipeline, and an upper end of the first elastic member is elastically pressed against a lower end of the first sealing member to elastically squeeze the first sealing member to move upward; and a water outlet valve including a second spool, a second elastic member and a second sealing member.

10 Claims, 6 Drawing Sheets

(58) Field of Classification Search
USPC ..... 222/4, 402.18, 396, 397, 400.7, 400.8, 222/510–512, 160, 165; 239/310, 317, 239/318, 306–308, 353, 354
See application file for complete search history.

(56) References Cited

U.S. PATENT DOCUMENTS

| | | | | |
|---|---|---|---|---|
| 4,021,343 | A * | 5/1977 | Tyler | B01D 61/08 210/257.2 |
| 6,311,875 | B1 * | 11/2001 | Anderson | B67D 1/0832 222/400.7 |
| 6,926,212 | B1 * | 8/2005 | Glass | E03C 1/046 239/320 |
| 9,051,167 | B2 * | 6/2015 | Burge | B67D 1/0831 |
| 2004/0035467 | A1 * | 2/2004 | Hecking | E03C 1/108 137/512 |

FOREIGN PATENT DOCUMENTS

| | | | |
|---|---|---|---|
| CN | 108310841 | A | 7/2018 |
| CN | 210286995 | U | 4/2020 |
| CN | 210419573 | U | 4/2020 |
| CN | 112263164 | A | 1/2021 |
| KR | 20120078011 | A | 7/2012 |

* cited by examiner

CONTAINER BOTTLE JOINT AND CONTAINER BOTTLE ASSEMBLY

CROSS-REFERENCE TO RELATED APPLICATIONS

The present application is a continuation of International Application PCT/CN2021/113312, filed on Aug. 18, 2021, which claims priority to Chinese Patent Application No. 202011286065.9, filed on Nov. 17, 2020, the entire contents of which are incorporated herein by reference.

TECHNICAL FIELD

The present application relates to the technical field of bath products, in particular to a container bottle joint and a container bottle assembly.

BACKGROUND

With the continuous development of science and technology, people's demand for quality of life is getting higher and higher. In order to improve the sanitary use of water by the user for bath products, an exemplary technology introduces a container bottle assembly having a water purification function in the channel of the bath system, and the water flow is controlled to flow to the filter cavity of the container bottle assembly through the switch of the bath system, and then discharged, or directly discharged.

However, when a filter member is arranged in the filter cavity of the container bottle assembly, the water inlet and the water outlet of the container bottle assembly are always in an open state. When there is no water flow in the channel where the water purification filter bottle is located, the filter member of the container bottle assembly is directly communicated with the channel, which leads to the filter member being easily attached by bacteria and microorganisms in the pipeline and affecting its own filtering effect and sanitary use.

When bath lotion is received in the filter cavity of the container bottle assembly, and the water inlet and the water outlet of the container bottle assembly are always in the open state, when there is no water flow in the channel where the water purification filter bottle is located, the bath lotion in the filter cavity is directly communicated with the channel, resulting in the bath lotion in the filter cavity flowing into the channel and a waste of resources and the like.

SUMMARY

The main purpose of the present application is to provide a container bottle joint, which is aimed at improving a sealing performance of the filter cavity of the container bottle assembly, so as to improve the hygiene of bathing water for users.

To realize the above purpose, the present application provides a cover body comprising a water inlet pipeline and a water outlet pipeline extending upper and lower direction;

a water inlet valve including a first spool, a first elastic member and a first sealing member, in particular the first spool is slidably arranged in the water inlet pipeline from top to bottom, and an upper end of the first spool is connected with the first sealing member; the first elastic member is arranged in the water inlet pipeline, and an upper end of the first elastic member is elastically pressed against a lower end of the first sealing member to elastically squeeze the first sealing member to move upward; and a water outlet valve including a second spool, a second elastic member and a second sealing member, in particular the second spool is slidably arranged in the water outlet pipeline from top to bottom, and a lower end of the second spool is connected with the second sealing member, the second elastic member is arranged in the water outlet pipeline, and a lower end of the second elastic member is elastically pressed against an upper end of the second sealing member to elastically squeeze the second sealing member to move downward;

the first sealing member forming a sealed contact with an edge of an opening od an upper end of the water inlet pipeline, and the second sealing member forming a sealed contact with an edge of an opening of the lower end of the first water outlet pipeline.

In one embodiment, the first spool includes a sliding rod extending up and down and a sealing rod fixed on an upper end of the sliding rod, the first sealing member is sleeved on an outer wall of the sealing rod, and a radial dimension of the sealing rod is larger than a radial dimension of the sliding rod, so that to make an outer annular wall of the first sealing member and an inner annular wall at the edge of the opening of the water inlet pipeline are contacted and sealed.

In one embodiment, an end surface of the first sealing member is provided with a fixing slot with an opening facing downward, and an upper end of the sealing rod is inserted in the first fixing slot through the opening;

an annular clamping groove is formed on an outer annular wall of the sealing rod in a horizontal direction, and an anti-slipping convex ring adapted to the annular clamping groove is arranged on an inner annular wall of the fixing slot, and the anti-slipping convex ring is clamped in the annular clamping groove.

In one embodiment, the cover body includes a water passing plate transversely provided in the water inlet pipeline, and the water passing plate is defined with a plurality of water inlet holes and a sliding hole for the sliding rod to slide through along upper and lower directions, and the first elastic member is elastically compressed between an upper end surface of the water passing plate and a lower end surface of the sealing rod.

In one embodiment, the first elastic member is a compression spring sleeved on an outer annular wall of the sliding rod.

In one embodiment, the water inlet valve and the water outlet valve are identical in structure.

In one embodiment, the cover body includes an annular wall and a cover plate which covers an upper edge of the annular wall, a lower end surface of the cover plate is provided with a water inlet round pipe extending from top to bottom, and the water inlet round pipe forms the water inlet pipeline;

an annular wall is protruded from outside to inside in a horizontal direction at an edge of an opening of an upper end of the water inlet round pipe, and a sealed contact is formed between an outer annular wall of the first sealing member and an inner annular wall of the annular wall.

In one embodiment, a lower end surface of the cover plate is provided with a water outlet round pipe extending from top to bottom, and the water outlet round forms the water outlet pipeline;

the cover body further includes a sealing round pipe sleeved on the water outlet round pipe, the sealing round pipe includes a sealing wall which covers an opening at a lower end of the water outlet round pipe, and a water outlet hole corresponding to the opening at the lower end of the water outlet round pipe, a radial dimension of the water outlet hole is smaller than a radial dimension of the opening at the lower end of the water outlet round pipe, and a sealed contact is formed between a lower end surface of the second sealing member and an upper end surface of the sealing wall.

In one embodiment, the cover body further includes a water control pipeline extending from top to bottom, and the container bottle joint further includes a water control valve arranged in the water control pipeline; in particular, the water control pipeline and the water inlet pipeline are identical in structure, and the water control valve and the water inlet valve are identical in structure.

The present application further provides a container bottle assembly including a bottle body, a bottle cap, and a container bottle joint, the container bottle joint includes:

a water inlet valve including a first spool, a first elastic member and a first sealing member, in particular the first spool is slidably arranged in the water inlet pipeline from top to bottom, and an upper end of the first spool is connected with the first sealing member; the first elastic member is arranged in the water inlet pipeline, and an upper end of the first elastic member is elastically pressed against a lower end of the first sealing member to elastically squeeze the first sealing member to move upward; and a water outlet valve including a second spool, a second elastic member and a second sealing member, in particular the second spool is slidably arranged in the water outlet pipeline from top to bottom, and a lower end of the second spool is connected with the second sealing member, the second elastic member is arranged in the water outlet pipeline, and a lower end of the second elastic member is elastically pressed against an upper end of the second sealing member to elastically squeeze the second sealing member to move downward;

the first sealing member forming a sealed contact with an edge of an opening od an upper end of the water inlet pipeline, and the second sealing member forming a sealed contact with an edge of an opening of the lower end of the first water outlet pipeline.

The upper and lower ends of the container bottle joint are connected to the bottle cap and the bottle body, respectively.

According to the technical proposal of the application, a water inlet valve is sliding installed in a water inlet pipeline of a cover body, a water outlet valve is sliding installed in the water outlet pipeline of the cover body. At the same time, an elastic telescopic function of a first elastic member of the water inlet valve is utilized, a first sealing member of the water inlet valve is elastically pressed against a periphery of the water inlet of the water inlet pipeline. By utilizing the elastic telescopic function of the second elastic member of the water outlet valve, the second sealing member of the water outlet valve is elastically pressed at the periphery of the water inlet of the water outlet pipeline, so that the cover body can be kept in a sealed state at all times when there is no water flowing outside the pipeline ports of the two pipelines, which is beneficial to improving a sealing performance of the filter cavity of the container bottle assembly and improving the hygiene of bathing water for users.

BRIEF DESCRIPTION OF THE DRAWINGS

In order to more clearly explain embodiments of the present application or the technical solution in the related art, the drawings required in a description of embodiments or related art will be briefly described below. It will be apparent that the drawings described below are only some embodiments of the present application, and other drawings may be obtained from the structure shown in these drawings without any creative effort by those of ordinary skill in the art.

Figure 1:
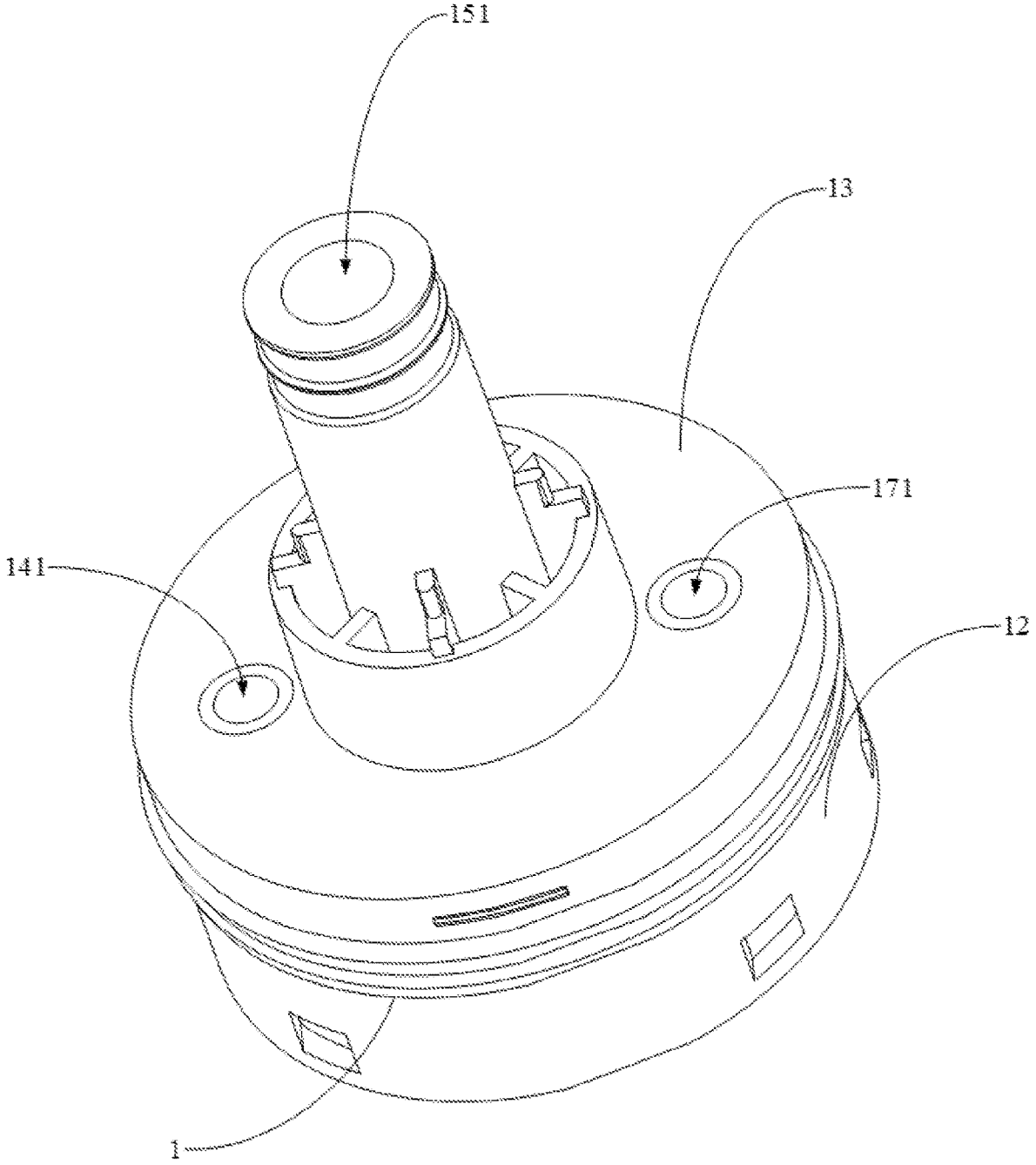
FIG. 1 is a structural schematic view of an embodiment of a container bottle joint of the present application.
Figure 2:
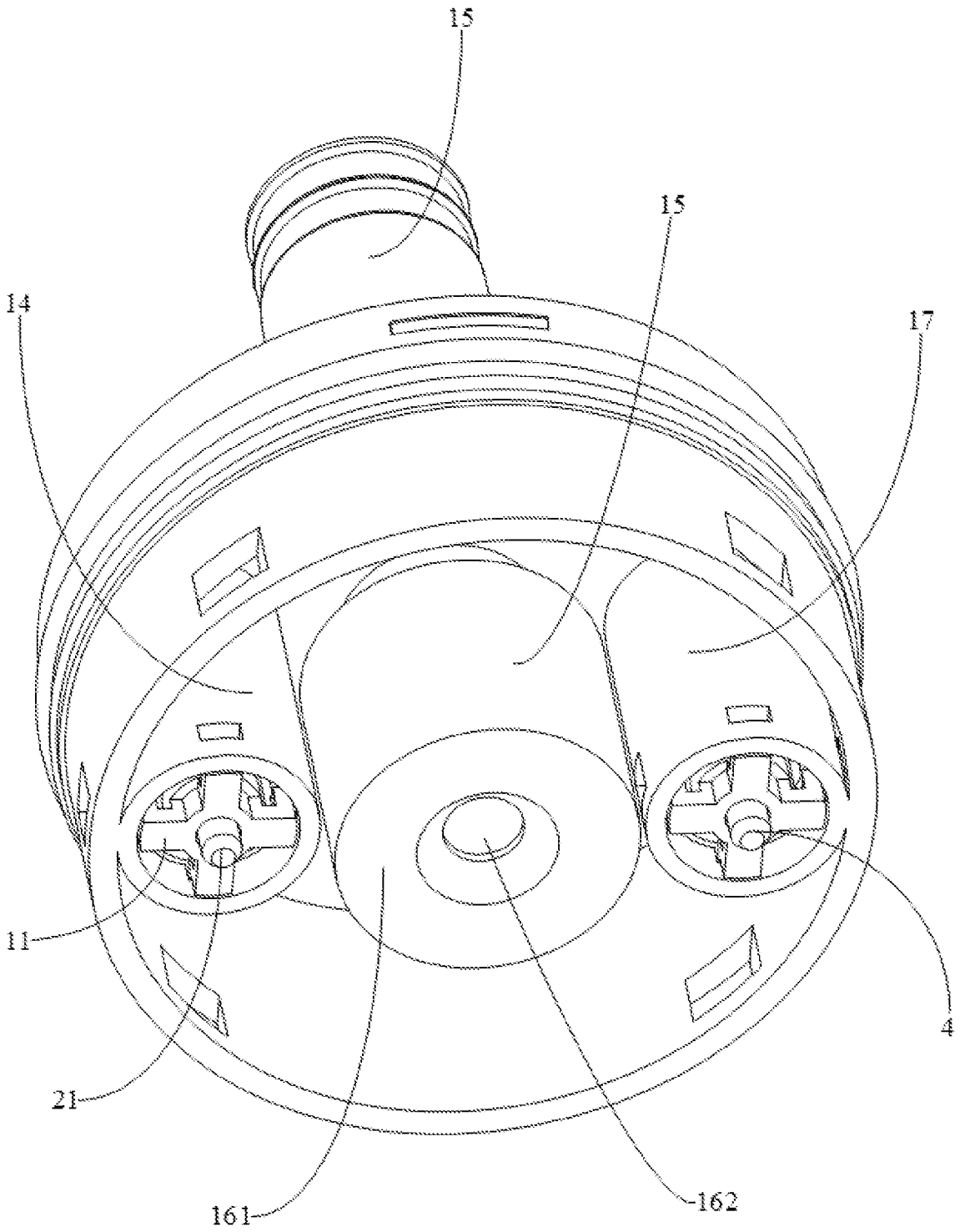
FIG. 2 is a structural schematic view of the container bottle joint of FIG. 1 from another perspective.
Figure 3:
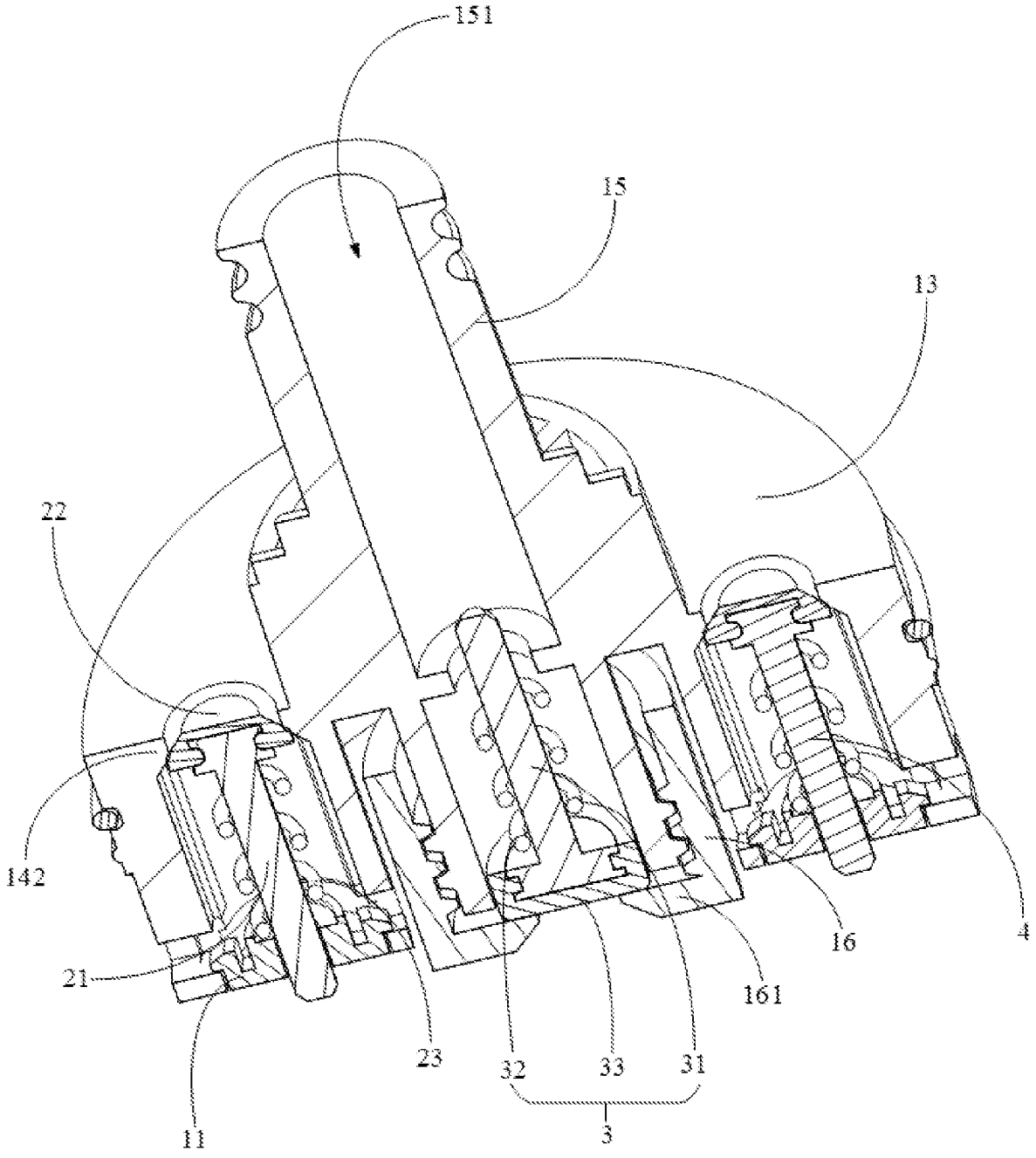
FIG. 3 is a cross-sectional view of the container bottle joint of FIG. 1.
Figure 4:
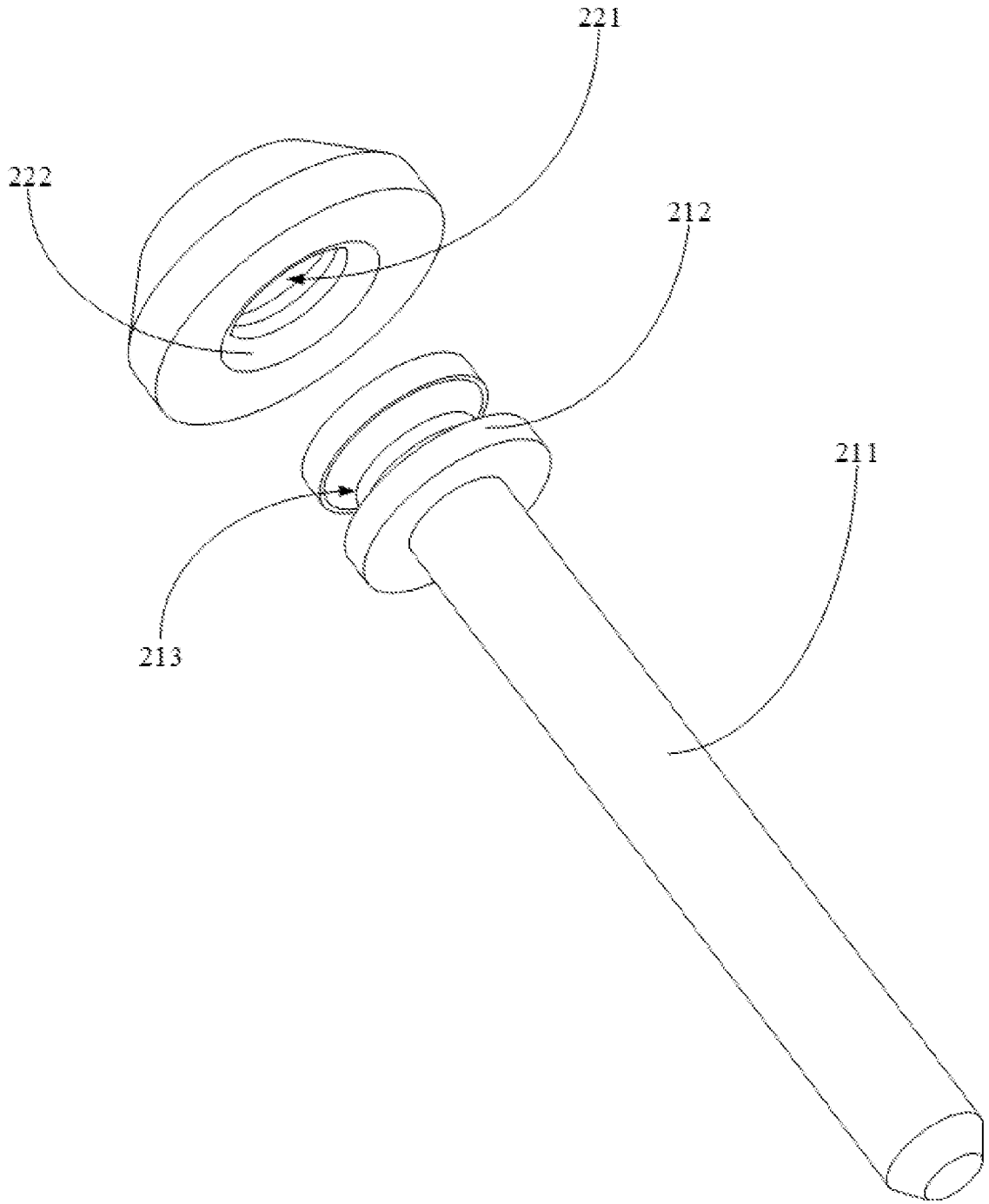
FIG. 4 is a partial structural view of the water inlet valve of the container bottle joint of FIG. 1.

The realization of the object, functional features and advantages of the present application will be further explained with reference to the accompanying drawings in connection with the embodiments.

DETAILED DESCRIPTION OF THE EMBODIMENTS

A clear and complete description of the technical aspects of the embodiments of the present application will be given below in conjunction with the accompanying drawings in the embodiments of the present application, and it will be apparent that the described embodiments are only parts of the embodiments of the present application, not all of them. Based on the embodiments in the present application, all other embodiments obtained by those of ordinary skill in the art without making creative efforts fall within the scope of the present application.

It should be noted that if there are indications (such as up, down, left, right, front, back, etc.) in the embodiments of the present application, the directivity indications are only used to explain the relative positional relationship and motion among the components under a specific posture (as shown in the drawing), and if the specific posture changes, the directivity indications will change accordingly.

In addition, if there are descriptions referring to "first", "second" and the like in embodiments of the present application, the descriptions of "first", "second" and the like are for descriptive purposes only and cannot be understood as indicating or implying their relative importance or implying the number of technical features indicated. Therefore, the features defined as "first", "second" may explicitly or implicitly include at least one of the features. In addition, the technical solutions among the various embodiments may be combined with each other, but must be on the basis that the person of ordinary skill in the art can realize it. When the combination of technical solutions conflicts or cannot be realized, it should be considered that the combination of technical solutions does not exist and is not within the scope claimed by the present application.

The present application provides a container bottle joint, which is mainly applied to container bottle assemblies.

Figure 5:
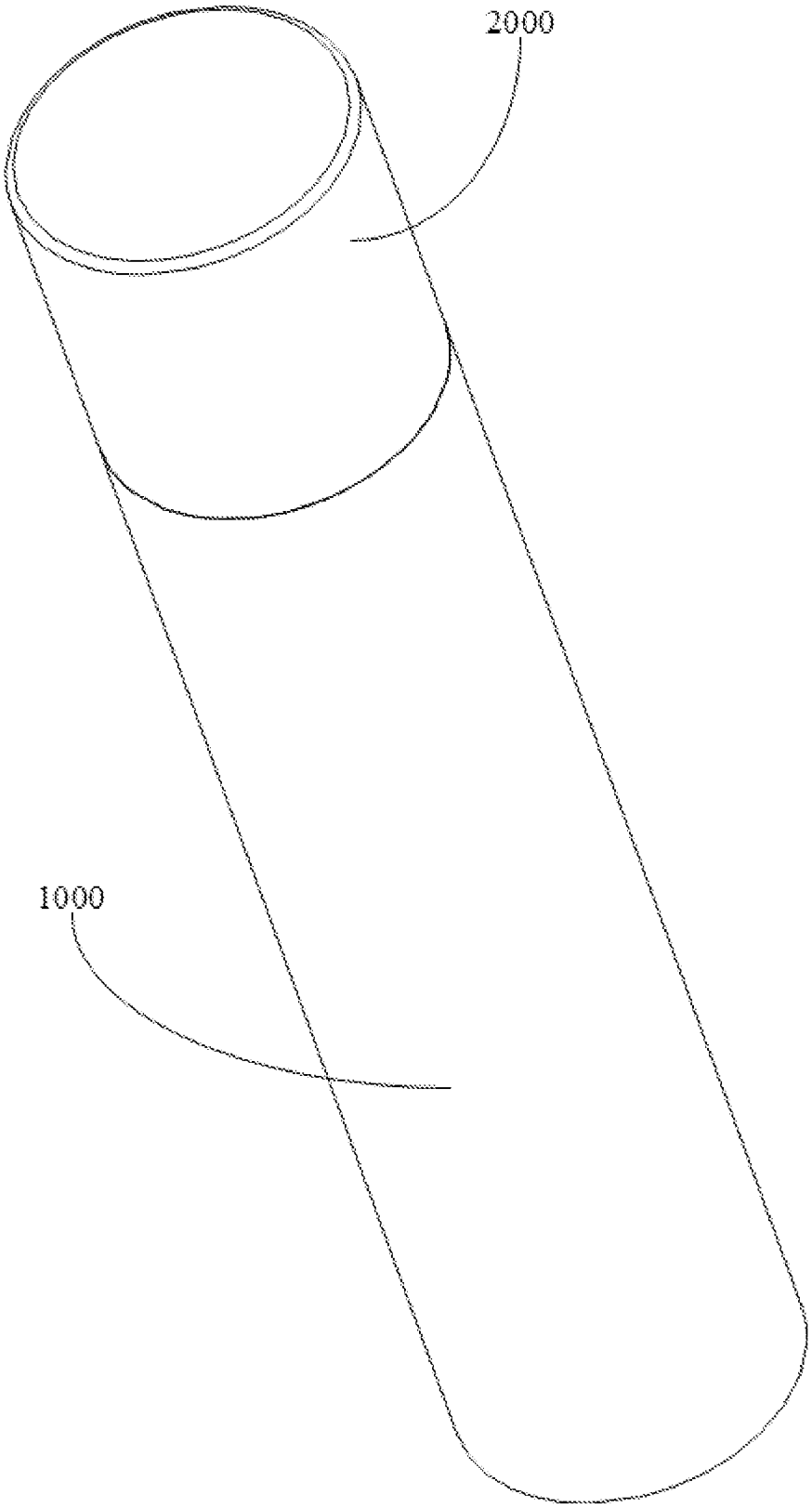
FIG. 5 is a schematic structural view of an embodiment of the container bottle assembly of the present application.
Figure 6:
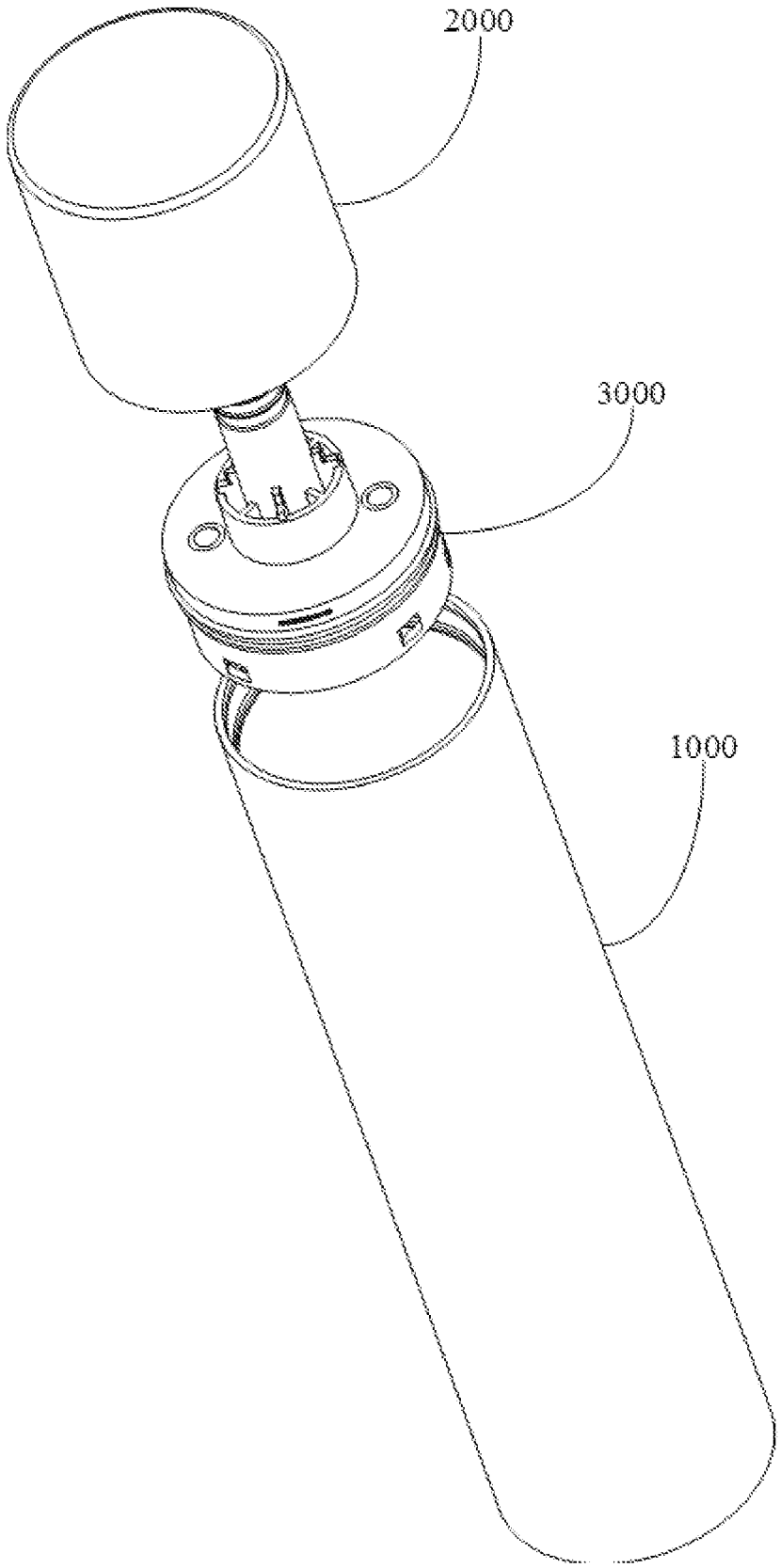
FIG. 6 is an explosion schematic view of the container bottle assembly of FIG. 5.

According to FIG. 5 and FIG. 6, in this embodiment, the container bottle assembly includes a bottle body 1000, a bottle cap 2000 and a container bottle joint 3000. The bottle body 1000 and the bottle cap 2000 are in a cylindrical shape and provided at two ends of the container bottle joint 3000 correspondingly. The bottle cap 2000 is enclosed and a protective cavity for receiving the container bottle joint 3000 is formed to avoid bumping against the container bottle joint 3000 by the outside world during transportation or daily storage. A filter member structure can be arranged in a filter cavity of the bottle body 1000, when the bottle cap 2000 is removed from the container bottle assembly and the container bottle assembly is mounted to a channel of a bath system, the user can control the water flow to the container bottle assembly through a switch to be filtered and then discharged, or be directly discharged without passing through the container bottle assembly. When the water flow in the bath system flows through the channel where the container bottle assembly is located, at this time, the container bottle assembly filters and purifies the water flowing into the bathing system and then discharges it. Therefore, it is beneficial to improve a hygiene of bathing water for users, when the water flow in the bath system does not flow through the channel where the container bottle assembly is located and is directly discharged to the outside, at this time, the filter cavity of the container bottle assembly is in a sealed state, The present application effectively avoids the problems such as filter member pollution caused by the attachment of bacteria and microorganisms in the pipeline, of course, in other embodiments, the filter member structure in the bottle body 1000 can also be replaced with bath lotion, so that in the process of bathing, a water control switch of the bath system selectively controls that the bath nozzle flows out bath liquid or clear water. It is beneficial to improve convenience of bathing for users, and when the water flow in the bathing system does not flow through the channel where the container bottle assembly is located and is directly discharged to the outside, the filter cavity of the container bottle assembly is in the sealed state at this time, thereby effectively avoiding a phenomenon of resource waste caused by bath liquid flowing into the pipeline.

A specific configuration of an embodiment of the container bottle joint 3000 will be described below, according to FIGS. 1 to 4, the container bottle joint 3000 includes:

a cover body 1 including a water inlet pipeline 141 and a water outlet pipeline 151 extending in upper and lower directions;

a water inlet valve 2 including a first spool 21, a first elastic member 23 and a first sealing member 22, where the first spool 21 is slidably arranged in the water inlet pipeline 141 in the upper and lower directions, and an upper end of the first spool 21 is connected with a first sealing member 22, the first elastic member 23 is arranged in the water inlet pipeline 141, and an upper end of the first elastic member 23 is elastically pressed against a lower end of the first sealing member 22 to elastically squeeze the first sealing member 22 to move upward; and a water outlet valve 3 including a second spool 31, a second elastic member 32 and a second sealing member 33, where the second spool 31 is slidably arranged in the water outlet pipeline 151 in the upper and lower directions, and a lower end of the second spool is connected with the second sealing member 33, the second elastic member 32 is arranged in the water outlet pipeline 151, and a lower end of the second elastic member 32 is elastically pressed against an upper end of the second sealing member 33 to elastically squeeze the second sealing member 33 to move downward; where, the first sealing member 22 is in a sealed contact with an edge of an opening of the upper end of the water inlet pipeline 141, and the second sealing member 33 is in contact with an edge of an opening of the lower end of the first water outlet pipeline 151 and seals the opening.

Understandably, the water inlet pipeline 141 is configured to guide the water in a bath system into the filter cavity. The water outlet pipeline 151 is configured to guide the filtered water in the filter cavity into the bath system. In upper and lower directions of the cover body 1, upper and lower ends of the water inlet pipeline 141 are a water inlet end and a water outlet end correspondingly, and upper and lower ends of the water outlet pipeline 151 are respectively a water outlet end and a water inlet end. After the first spool 21 and the first sealing member 22 are installed together, under an elastic abutment action of the first elastic member 23, the first sealing member 22 is in sealed contact with the edge of the opening of the water inlet end of the water inlet pipeline 141. After the container bottle joint 3000 is installed in the bath system and when an impact force of the water in the bath system on the first sealing member 22 is greater than an elastic force of the first elastic member 23, that is, when the user is in a state of bathing and using water, at this time, the first sealing member 22 slides downward, the opening of the water inlet end of the water inlet pipeline 141 is opened, the water passes between the first sealing member 22 and the inner wall of the water flow pipeline and flows to the filter cavity of the bottle body 1000, at this time, the water inlet pipeline 141 is in a conductive state. When the impact force of the water in the bath system on the first sealing member 22 is less than the elastic force of the first elastic member 23, that is, when the user is not in the bathing state, the first sealing member 22 slides upward and is sealed and abutted with the edge of the opening of the water inlet end of the water inlet pipeline 141, and the water inlet pipeline 141 is in a closed state, thereby ensuring a hygiene of water used by the user and improving a sealing performance of the filter cavity. The water outlet pipeline 151 and the water outlet valve 3 also adopts a same working principle and will not be described here.

In this embodiment, the cover body 1 includes an annular wall 12 and a cover plate 13 which covers an upper edge of the annular wall 12. An outer annular wall of the annular wall 12 is configured for engaging with the bottle body 1000 and the bottle cap 2000. Specifically, the outer annular wall of the annular wall 12 is protruded with a first thread. The inner annular wall of the filter cavity of the bottle body 1000 is protruded with a second thread engageable with the first thread. This arrangement facilitates assembly and disassembly of both the bottle 1000 and the container bottle joint 3000 by the user. Of course, in other embodiments, the outer annular wall of the annular wall 12 can be inserted on an inner annular wall of the filter cavity of the bottle 1000 without limitation. Without losing generality, at an upper end of the first thread, an outer annular wall of the annular wall 12 is further recessed with an annular groove. The cover body 1 also includes a waterproof ring arranged in the annular groove, the waterproof ring is partly exposed at an opening of the annular groove, and upper and lower sides of the waterproof ring are respectively configured for establishing sealed contacts with the edge of the opening of the bottle cap 2000 and the edge of the opening of the bottle body 1000, so that the arrangement is beneficial to improving a connection tightness between components of the container bottle assembly.

The cover plate 13 and the annular wall 12 are enclosed together to form a hollow cavity communicating with the filter cavity of the bottle body 1000. A lower end surface of the cover plate 13, that is, one side adjacent to the hollow cavity, a water inlet round pipe 14 and a water outlet round pipe 15 extending in the upper and lower directions are protruded. Each of them is defined with the water inlet pipeline 141 or the water outlet pipeline 151 extending in the upper and lower directions correspondingly. In this embodiment, the water inlet pipeline 141 and the water outlet pipeline 151 are designed with round pipes on the cover body 1, and the outer spaces of the round pipes are hollowed out, so that a weight of the cover plate 13 is reduced, which is beneficial to a lightweight of the product, saving of materials and reduction of development cost. Specifically, the water outlet pipe 15 includes a first pipe section which is erected on the lower end surface of the cover plate 13 and a second pipe section which is erected on an upper end surface of the cover plate 13. The two pipe sections communicate with each other to form the water outlet pipeline 151. It is easily to understand, the openings of the water inlet pipeline 141 and the water outlet pipeline 151 on the upper end surface of the cover plate 13 are connected with the water flow pipeline of the bathing system. In this embodiment, the openings of the two pipelines are respectively arranged on horizontal planes on different heights, which is beneficial to avoid mutual interference of the water at the two openings. In addition, the structure form of the second pipeline section is also convenient for users to align with the nozzle of the water flow pipeline of the bath system to insert the container bottle joint 3000 on the water flow pipeline of the bath system, which is beneficial to improving the installation convenience of users.

In one embodiment, the cover body 1 further includes a water control pipeline 171 extending in the upper and lower directions, and the container bottle joint 3000 further includes a water control valve 4 arranged in the water control pipeline 171. The water control pipeline 171 and the water inlet pipeline 141 have the same structure, and the water control valve 4 and the water inlet valve 2 have the same structure. In this embodiment, the lower end surface of the cover plate 13 is also provided with a water control pipe 17 extending in the upper and lower directions. The water control pipe 17 is defined with the water control pipeline 171. Understandably, inlet water inlet pipeline 141 and water control pipeline 171 are both configured to direct water in the water flow pipeline of the bath system into the filter cavity of the bottle body 1000. This arrangement is convenient for more water to flow into the filter cavity for filtering, thus improving the filtering efficiency of the product. In addition, the control water pipeline and the water inlet pipeline 141 have the same structure, and the water control valve 4 and the water inlet valve 2 have the same structure, which is beneficial to reducing the development cost in the manufacture process. Of course, the present application is not limited thereto. In other embodiments, the container bottle joint 3000 may be provided with three or more water inlet pipelines 141, and a structure of each water inlet pipeline 141 may be provided differently from each other without limitation.

According to the technical proposal of the present application, a water inlet valve 2 is slidably installed in a water inlet pipeline 141 of a cover body 1. A water outlet valve 3 is slidably installed in a water outlet pipeline 151 of the cover body 1. At the same time, utilizing the elastic function of the first elastic member 23 of the water inlet valve 2 to retract or stretch, the first sealing member 22 of the water inlet valve 2 is elastically pressed against on the edge of the water inlet end of the water inlet pipeline 141. By utilizing an elastic function of the second elastic member 32 of the water outlet valve 3 to retract or stretch, the second sealing member 33 of the water outlet valve 3 is elastically pressed on the edge of the water inlet end of the water outlet pipeline 151, so that the cover body 1 can be kept in a sealed state at all times when there is no water flowing outside the openings of the two pipelines, which is beneficial to improving the sealing performance of the filter cavity of the container bottle assembly and improving the hygiene of bathing water for users.

In an embodiment, the first spool 21 includes a sliding rod 211 extending in the upper and lower directions, and a sealing rod 212 fixed to an upper end of the sliding rod 211. The first sealing member 22 is sleeved on an outer wall of the sealing rod 212, and a radial dimension of the sealing rod 212 is larger than that of the sliding rod 211, so as to contact the outer annular wall of the first sealing member 22 with the inner annular wall at the opening of the water inlet pipeline 141. Understandably, the first spool 21 and the first sealing member 22 are arranged inside the water inlet pipeline 141, compared with a configuration in which the first spool 21 and the first sealing member 22 are arranged outside the water inlet pipeline 141. The present application can effectively prevent the first spool 21 and the first sealing member 22 from being attached by bacteria and microorganisms in pipelines of the bathing system to affect the use hygiene of the water inlet valve 2, thereby being beneficial to improving the use reliability of the product and improving the hygiene of bathing water for users. It should be noted that the present design is not limited to this, and in other embodiments, the first spool 21 and the first sealing member 22 can be arranged outside the water inlet pipeline 141, which is not limited.

In one embodiment, a lower end surface of the first sealing member 22 is provided with a fixing slot 221 with an opening facing downward, and an upper end of the sealing rod 212 is inserted in the fixing slot 221 through the opening. An outer annular wall of the sealing rod 212 is recessed in a horizontal direction to form an annular clamping groove 213, and an inner annular wall of the fixing slot 221 is provided with an anti-slipping convex ring 222 engageable with the annular clamping groove 213, and the anti-slipping convex ring 222 is clamped in the annular clamping groove 213. Understandably, the plug-in assembly between the first sealing member 22 and the sealing rod 212 is a removable mounting mode widely used in the related art, the present application has the advantages of convenient installation, reliable connection, etc. It should be noted that the present design is not limited thereto. In other embodiments, the first sealing member 22 and the sealing rod 212 can also be fixedly connected by a clamping connection, which is not limited here. Moreover, the anti-slipping convex ring 222 is clamped in the annular clamping groove 213, thereby further improving the connection precision between the first sealing member 22 and the sealing rod 212, and improving the service reliability of the product.

In one embodiment, the first elastic member 23 is a compression spring sleeved on the outer annular wall of the sliding rod 211. It can be understood that the compression spring is an elastic member widely used in the related art, which has the advantages of being easily obtained, having a stable structure and the like, and is beneficial to reduce the development and manufacturing cost of the product. It should be noted that the present application is not limited to this and in other embodiments, the first elastic member 23 may be a component having an elastic structure such as a rubber.

In one embodiment, the cover body 1 is provided with a water passing plate 11 transversely in the water inlet pipeline 141, and the water passing plate 11 is provided with a plurality of water inlet holes and a sliding hole for the sliding rod 211 to slide along the upper and lower directions. The first elastic member 23 is elastically compressed between an upper end surface of the water passing plate 11 and an lower end surface of the sealing rod 212. Understandably, during mounting, the first elastic member 23 is first sleeved on the outer annular wall of the sliding rod 211. Then, the upper end of the first spool 21 is clamped and fixed with the first sealing member 22, and the upper end of the first spool 21 is inserted in the water inlet pipeline 141 from the opening of the water outlet end of the water inlet pipeline 141, so that the lower end of the first spool 21 passes through the sliding hole of the water inlet plate 11, and the first elastic member 23 is pressed upward and fixed on the pipeline wall of the water inlet pipeline 141. In this way, installation of the water inlet valve 2 can be realized quickly. Specifically, the pipeline wall of the water inlet pipeline 14 is penetrated with a clamping groove, and the periphery of the water passing plate 11 is protruded with a clamping buckle engaged in the clamping groove for clamping and fixing with the water inlet pipeline 14. It should be noted that the present application is not limited to this, and in other embodiments, the water passing plate 11 may be inserted into the water inlet pipeline 14 in an interference manner, which is not limited.

In one embodiment, the water inlet valve 2 and the water outlet valve 3 are arranged in the same structure. Understandably, this arrangement effectively reduces a development time and development cost of the water inlet valve 2 and the water outlet valve 3 in the process, and is also beneficial to a rapid production of the two structures: the water inlet valve 2 and the water outlet valve 3 in the process. Of course, the present application is not limited to this, and in other embodiments, the water inlet valve 2 and the water outlet valve 3 can also be arranged in different structures without limitation.

In one embodiment, an annular wall 142 is protruded from the outside to the inside of the edge of the opening of the upper end of the water inlet pipeline 14 in the horizontal direction, and the outer annular wall of the first sealing member 22 forms a sealed contact with the inner annular wall of the annular wall 142. Understandably, a radial dimension of the water passing hole formed by the annular wall 142 is smaller than a radial dimension of the pipeline of the water inlet pipe 14, so that the sliding space between the water inlet valve 2 and the water inlet of the water inlet pipeline 14 can be effectively ensured, and the sealing connection between the water inlet valve 2 and the water inlet of the water inlet pipe 14 can also be effectively ensured, which is beneficial to improving the service reliability of the product. It should be noted that the present application is not limited thereto and in other embodiments, the water inlet pipeline 14 may be specifically designed for other configurations and is not limited here.

In an embodiment, the cover body 1 further includes a sealing round pipe 16 sleeved on the water outlet round pipe 15. The sealing round pipe 16 includes a sealing wall 161 which covers the opening of the lower end of the water outlet pipeline 15, and a water outlet hole 162 which is provided corresponding to the opening of the lower end of the water outlet pipe 15. The radial dimension of the water outlet hole 162 is smaller than the radial dimension of the opening of the lower end of the water outlet pipe 15, and the lower end surface of the second sealing member 33 seals and abuts against an upper end surface of the sealing wall 161. It can be understood that this arrangement can effectively ensure a sliding space for the water outlet valve 3 in the water outlet pipe 15, and at the same time effectively ensure a sealed connection between the water outlet valve 3 and the water inlet of the water outlet pipeline 15, which is beneficial to improving the use reliability of the product. Specifically, in order to facilitate an installation and fixation of the sealing pipeline 16 for the user, in this embodiment, a third thread is protruded on an inner annular wall of the sealing pipe 16, and a fourth thread engageable with the third thread is protruded on an outer annular wall of the water outlet pipeline 15 to be threaded with the water outlet pipeline 15. It should be noted that the present application is not limited thereto, and in other embodiments, the sealing pipeline 16 and the water outlet pipe 15 may be fitted to each other by a clamping connection, which is not limited.

The above is only a preferred embodiment of the present application, and is not therefore limiting the scope of the present application. Any equivalent structural transformation made by using the contents of the specification and drawings of the present application or any direct/indirect application in other related technical fields under the inventive concept of the present application is included in the scope of the present application.

The invention claimed is:

1. A container bottle joint for a container bottle assembly comprising:

a cover body comprising a water inlet pipeline and a water outlet pipeline extending upper and lower direction;

a water inlet valve comprising a first spool, a first elastic member and a first sealing member, wherein the first spool is slidably arranged in the water inlet pipeline from top to bottom, and an upper end of the first spool is connected with the first sealing member; the first elastic member is arranged in the water inlet pipeline, and an upper end of the first elastic member is elastically pressed against a lower end of the first sealing member to elastically squeeze the first sealing member to move upward; and a water outlet valve comprising a second spool, a second elastic member and a second sealing member, wherein the second spool is slidably arranged in the water outlet pipeline from top to bottom, and a lower end of the second spool is connected with the second sealing member, the second elastic member is arranged in the water outlet pipeline, and a lower end of the second elastic member is elastically pressed against an upper end of the second sealing member to elastically squeeze the second sealing member to move downward;

the first sealing member forming a sealed contact with an edge of an opening of an upper end of the water inlet pipeline, and the second sealing member forming a sealed contact with an edge of an opening of the lower end of the first water outlet pipeline.

2. The container bottle joint according to claim 1, wherein the first spool comprises a sliding rod extending up and down and a sealing rod fixed on an upper end of the sliding rod, the first sealing member is sleeved on an outer wall of the sealing rod, and a radial dimension of the sealing rod is larger than a radial dimension of the sliding rod, so that to make an outer annular wall of the first sealing member and an inner annular wall at the edge of the opening of the water inlet pipeline are contacted and sealed.

3. The container bottle joint according to claim 2, wherein an end surface of the first sealing member is provided with a fixing slot with an opening facing downward, and an upper end of the sealing rod is inserted in the fixing slot through the opening;

an annular clamping groove is formed on an outer annular wall of the sealing rod in a horizontal direction, and an anti-slipping convex ring adapted to the annular clamping groove is arranged on an inner annular wall of the fixing slot, and the anti-slipping convex ring is clamped in the annular clamping groove.

4. The container bottle joint according to claim 2, wherein, the cover body comprises a water passing plate transversely provided in the water inlet pipeline, and the water passing plate is defined with a plurality of water inlet holes and a sliding hole for the sliding rod to slide through along upper and lower directions, and the first elastic member is elastically compressed between an upper end surface of the water passing plate and a lower end surface of the sealing rod.

5. The container bottle joint according to claim 4, wherein the first elastic member is a compression spring sleeved on an outer annular wall of the sliding rod.

6. The container bottle joint according to claim 1, wherein the water inlet valve and the water outlet valve are identical in structure.

7. The container bottle joint according to claim 1, wherein the cover body comprises an annular wall and a cover plate which covers an upper edge of the annular wall, a lower end surface of the cover plate is provided with a water inlet round pipe extending from top to bottom, and the water inlet round pipe forms the water inlet pipeline;

an annular wall is protruded from outside to inside in a horizontal direction at an edge of an opening of an upper end of the water inlet round pipe, and a sealed contact is formed between an outer annular wall of the first sealing member and an inner annular wall of the annular wall.

8. The container bottle joint according to claim 7, wherein a lower end surface of the cover plate is provided with a water outlet round pipe extending from top to bottom, and the water outlet round forms the water outlet pipeline;

the cover body further comprises a sealing round pipe sleeved on the water outlet round pipe, the sealing round pipe comprises a sealing wall which covers an opening at a lower end of the water outlet round pipe, and a water outlet hole corresponding to the opening at the lower end of the water outlet round pipe, a radial dimension of the water outlet hole is smaller than a radial dimension of the opening at the lower end of the water outlet round pipe, and a sealed contact is formed between a lower end surface of the second sealing member and an upper end surface of the sealing wall.

9. The container bottle joint according to claim 1, wherein the cover body further comprises a water control pipeline extending from top to bottom, and the container bottle joint further comprises a water control valve arranged in the water control pipeline; wherein, the water control pipeline and the water inlet pipeline are identical in structure, and the water control valve and the water inlet valve are identical in structure.

10. A container bottle assembly comprising a bottle body, a bottle cap, and the container bottle joint according to claim 1, wherein upper and lower ends of the container bottle joint are connected to the bottle cap and the bottle body correspondingly.

* * * * *